US007508125B2

(12) United States Patent
Oh

(10) Patent No.: US 7,508,125 B2
(45) Date of Patent: Mar. 24, 2009

(54) FIELD EMISSION DISPLAY (FED) HAVING ELECTRON EMISSION STRUCTURE TO IMPROVE FOCUSING CHARACTERISTICS OF ELECTRON BEAM

(75) Inventor: Tae-Sik Oh, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 358 days.

(21) Appl. No.: 11/315,177

(22) Filed: Dec. 23, 2005

(65) Prior Publication Data

US 2006/0214559 A1 Sep. 28, 2006

(30) Foreign Application Priority Data

Jan. 7, 2005 (KR) ..... 10-2005-0001543

(51) Int. Cl.
*H01J 1/62* (2006.01)

(52) U.S. Cl. ..... 313/497; 313/495

(58) Field of Classification Search ..... 313/497
See application file for complete search history.

(56) References Cited

U.S. PATENT DOCUMENTS

2004/0004429 A1* 1/2004 Oh et al. ..... 313/495
2004/0169151 A1* 9/2004 Yagi et al. ..... 250/492.2

* cited by examiner

*Primary Examiner*—Toan Ton
*Assistant Examiner*—Britt Hanley
(74) *Attorney, Agent, or Firm*—Robert E. Bushnell, Esq.

(57) ABSTRACT

A Field Emission Display (FED) includes: a first substrate; a cathode electrode arranged on the first substrate in a first direction; a cathode focusing electrode arranged on the cathode electrode and having a rectangular first aperture elongated in the first direction; a gate electrode having a plurality of third apertures arranged in a second direction in regions where the gate electrode overlaps the cathode electrode and connected to the first aperture; and an emitter arranged on the cathode electrode within the first aperture.

12 Claims, 7 Drawing Sheets

FIELD EMISSION DISPLAY (FED) HAVING ELECTRON EMISSION STRUCTURE TO IMPROVE FOCUSING CHARACTERISTICS OF ELECTRON BEAM

CLAIM OF PRIORITY

This application makes reference to, incorporates the same herein, and claims all benefits accruing under 35 U.S.C. §119 from an application earlier filed in the Korean Intellectual Property Office on Jan. 7, 2005 and there duly assigned Serial No. 10-2005-0001543.

BACKGROUND OF THE INVENTION

1. Field of the Invention

The present invention relates to a Field Emission Display (FED), and more particularly, to a FED with an electron emission structure capable of improving the focusing characteristics of electron beams as well as uniformity of current density distribution.

2. Description of the Related Art

A conventional display that is an essential part of an information transfer medium has been commonly used as a PC monitor or a TV screen. Displays are largely classified into Cathode Ray Tubes (CRTs) based on high-speed thermal electron emission and Flat Panel Displays (FPDs) showing rapid growth, such as Liquid Crystal Displays (LCDs), Plasma Display Panels (PDPs), and Field Emission Displays (FEDs).

In an FED, emitters arranged on a cathode electrode at regular intervals emit electrons when a strong electric field is applied from a gate electrode. The electrons from the emitters strike and excite a phosphor material formed on an anode electrode, causing it to emit light. The image quality characteristics of an FED in which electrons emitted from a cold cathode are focused on a screen to create an image are significantly affected by the material or structure of an emitter as an electron source.

At an early stage of development, an FED used a metal tip (micro-tip) made of molybdenum (Mo) as an emitter. However, the FED with a metal-tip emitter requires the formation of ultra-microscopic holes to arrange emitters and Mo deposition for formation of a uniform metal micro-tip across the entire screen surface. Thus, the FED requires a complicated fabrication process, a highly sophisticated technology, and the use of expensive equipment, resulting in high manufacturing costs. Thus, the FED with a metal-tip emitter has a restriction on increasing its screen size.

To facilitate electron emission at low driving voltage and simplify the manufacturing process, the FED industry is conducting research into a technology for the fabrication of a planar emitter.

According to a current technology, a carbon-based material such as graphite, diamond, Diamond like Carbon (DLC), $C_{60}$ (Fulleren), or Carbon NanoTubes (CNTs) are suitable for forming a planar emitter. In particular, the CNTs emerge as the most ideal material for forming an emitter of a FED since they allow easy electron emission at low driving voltage.

A FED typically has a triode structure with a cathode electrode, an anode electrode, and a gate electrode. That is, the FED includes cathode electrodes and gate electrodes formed on a rear substrate, the anode electrode formed on a front substrate, and phosphor layers consisting of Red (R), Green (G), and Blue (B) phosphors and black matrices for improving contrast formed on the anode electrode. The rear and front substrates and are spaced apart by a spacer located therebetween. A method of fabricating the FED involves forming the cathode electrodes on the rear surface on which emitters will be arranged, sequentially forming an insulating layer with microscopic apertures and the gate electrodes on the cathode electrodes, and arranging emitters on the cathode electrodes within the apertures 15.

However, the triode-type FED suffers degradation in color purity and difficulty in realizing a sharp image because electron beams emitted from the emitter toward the phosphor layers diverge due to the positive voltage (several tens of volts) supplied to the gate electrode such that not only phosphors at a desired pixel but also adjacent phosphors emit light.

To prevent divergence of an electron beam, a FED with a gate focusing electrode for focusing an electron beam on a gate electrode has been proposed. Such a FED includes a gate focusing electrode that is formed on a second insulating layer deposited on a gate electrode and controls the trajectory of an electron beam.

However, the FED with the gate focusing electrode can suffer poor focusing due to changes in anode voltage and gate focusing voltage. A beam profile becomes uneven as a gate focusing voltage varies, resulting in poor focusing. The poor focusing causes electrons to excite a phosphor layer other than the target phosphor layer, thereby degrading pixel uniformity.

SUMMARY OF THE INVENTION

The present invention provides a Field Emission Display (FED) having an electron emission structure capable of improving the focusing characteristics of an electron beam, thus providing a wide color reproduction range, and increasing the uniformity of current density distribution to improve white uniformity, and a method of fabricating the FED.

According to one aspect of the present invention, an FED is provided including: a first substrate; a cathode electrode arranged on the first substrate in a first direction; a cathode focusing electrode arranged on the cathode electrode and having a rectangular first aperture elongated in the first direction; an insulating layer arranged on the first substrate to cover the cathode focusing electrode and having a plurality of second apertures arranged in regions where the insulating layer overlaps the cathode electrode in a second direction perpendicular to the first direction and connected to the first aperture; a gate electrode arranged on the insulating layer to extend in the second direction and having a plurality of third apertures connected to the corresponding second apertures; an emitter arranged on the cathode electrode within the first aperture; and a second substrate arranged opposite to and spaced apart from the first substrate and having an anode electrode and a phosphor layer thereon.

The width of the third aperture in the second direction is preferably greater than the width of the first aperture in the second direction. The third aperture is preferably elongated in the second direction. The first aperture preferably corresponds to each pixel, and the plurality of second and third apertures are preferably arranged for each pixel. The cathode electrode is preferably electrically connected to the cathode focusing electrode. The emitter preferably includes a carbon-based material. The emitter preferably includes Carbon NanoTubes (CNTs).

According to another aspect of the present invention, an FED is provided including: a first substrate; a cathode electrode arranged on the first substrate in a first direction; a cathode focusing electrode arranged on the cathode electrode and having a rectangular first aperture elongated in the first direction; a first insulating layer arranged on the first substrate to cover the cathode focusing electrode and having a plurality of second apertures arranged in regions where the insulating layer overlaps the cathode electrode in a second direction perpendicular to the first direction and connected to the first aperture; a gate electrode arranged on the first insulating layer to extend in the second direction and having a plurality of third apertures connected to the corresponding second apertures; a second insulating layer arranged on the first insulating layer and having a fourth aperture elongated in the first direction and connected to the third apertures; a gate focusing electrode arranged on the second insulating layer and having a fifth aperture connected to the fourth aperture; an emitter arranged on the cathode electrode within the first aperture; and a second substrate arranged opposite to and spaced apart from the first substrate and having an anode electrode and a phosphor layer thereon.

The width of the third aperture in the second direction is preferably greater than the width of the first aperture in the second direction. The third aperture is preferably transversely elongated in the second direction. The width of the fifth aperture in the second direction is preferably greater than the width of the third aperture in the second direction. The width of the fifth aperture is preferably greater than the width of the first aperture and less than the width of the third aperture. The first aperture preferably corresponds to each pixel, and the plurality of second and third apertures are preferably arranged for each pixel. The cathode electrode is preferably electrically connected to the cathode focusing electrode. The emitter preferably includes a carbon-based material. The emitter preferably includes Carbon NanoTubes (CNTs).

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1A:
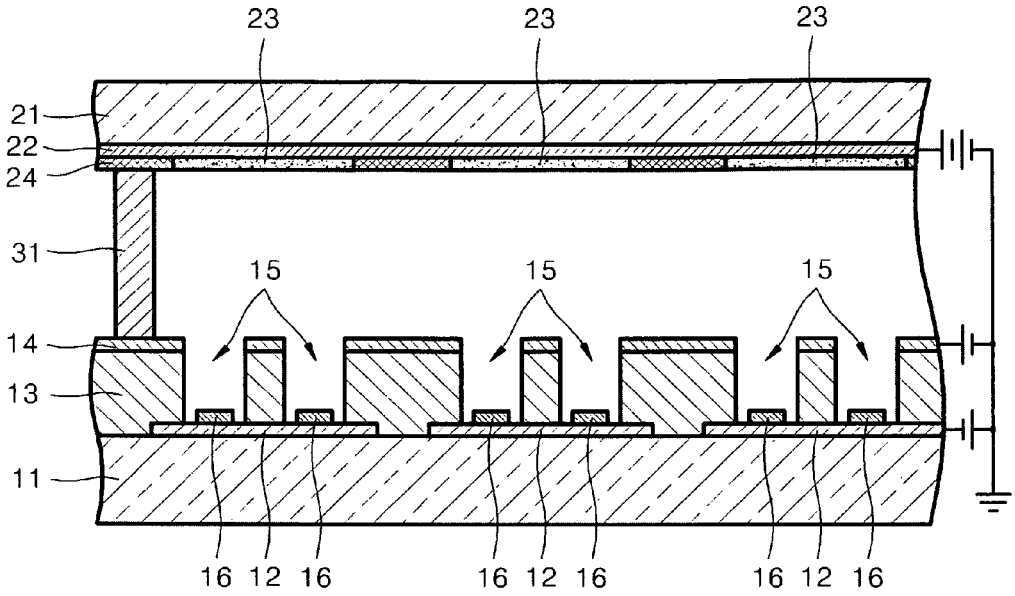
FIG. 1A (PRIOR ART)
FIGS. 1A and 1B are respectively a partial cross-sectional view and a partial top view of an field emission display (FED)
Figure 1B:
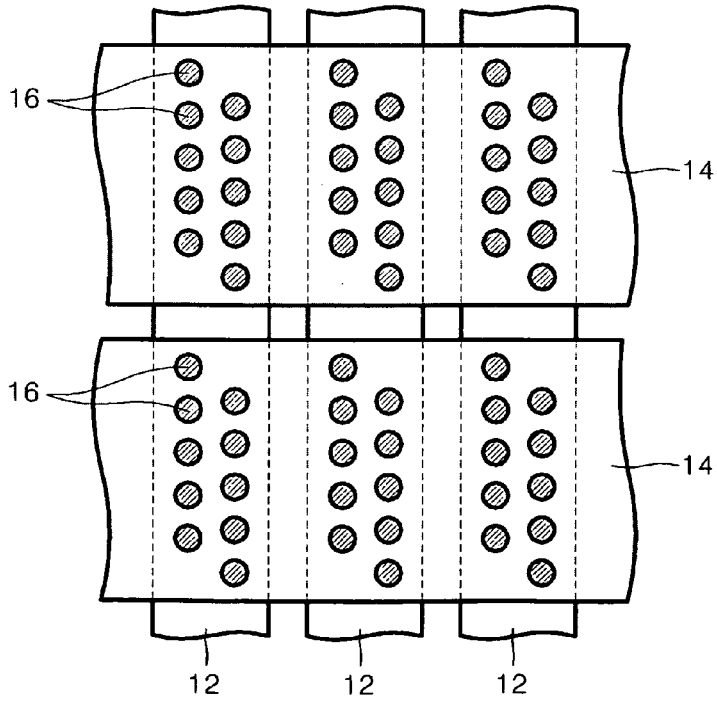
FIG. 1B (PRIOR ART)

FIGS. 1A and 1B are respectively a partial cross-sectional view and a partial top view of an field emission display (FED). Referring to FIGS. 1A and 1B, the FED typically has a triode structure with a cathode electrode 12, an anode electrode 22, and a gate electrode 14. That is, the FED includes cathode electrodes 12 and gate electrodes 14 formed on a rear substrate 11, the anode electrode 22 formed on a front substrate 21, and phosphor layers 23 consisting of Red (R), Green (G), and Blue (B) phosphors and black matrices 24 for improving contrast formed on the anode electrode 22. The rear and front substrates 11 and 21 are spaced apart by a spacer 31 located therebetween. A method of fabricating the FED involves forming the cathode electrodes 12 on the rear surface 11 on which emitters 16 will be arranged, sequentially forming an insulating layer 13 with microscopic apertures 15 and the gate electrodes 14 on the cathode electrodes 12, and arranging emitters on the cathode electrodes 12 within the apertures 15.

However, the triode-type FED suffers degradation in color purity and difficulty in realizing a sharp image because electron beams emitted from the emitter 16 toward the phosphor layers 23 diverge due to the positive voltage (several tens of volts) supplied to the gate electrode 14 such that not only phosphors at a desired pixel but also adjacent phosphors emit light.

Figure 2:
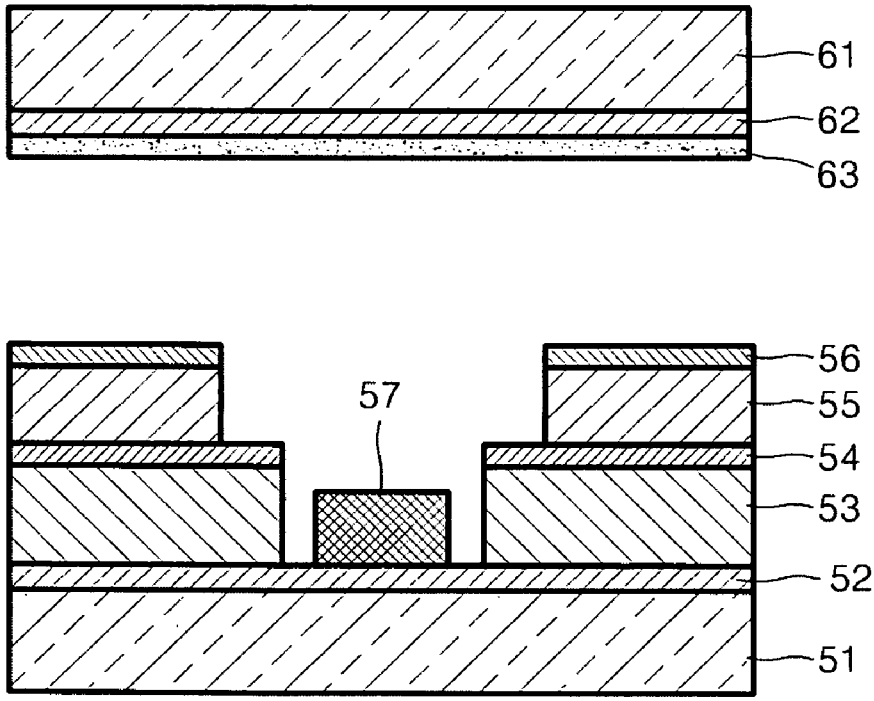
FIG. 2 (PRIOR ART)
FIG. 2 is a cross-sectional view of another example of an FED.

To prevent divergence of an electron beam, a FED with a gate focusing electrode for focusing an electron beam on a gate electrode has been proposed. An example of the proposed FED is shown in FIG. 2. Referring to FIG. 2, the FED includes a gate focusing electrode 56 that is formed on a second insulating layer 55 deposited on a gate electrode 54 and controls the trajectory of an electron beam. Reference numerals 51, 52, 53, and 57 in FIG. 2 respectively denote a rear substrate, a cathode electrode, a first insulating layer, and an electron emitter. Reference numerals 61, 62, and 63 respectively denote a front substrate, an anode electrode, and a phosphor layer.

Figure 3:
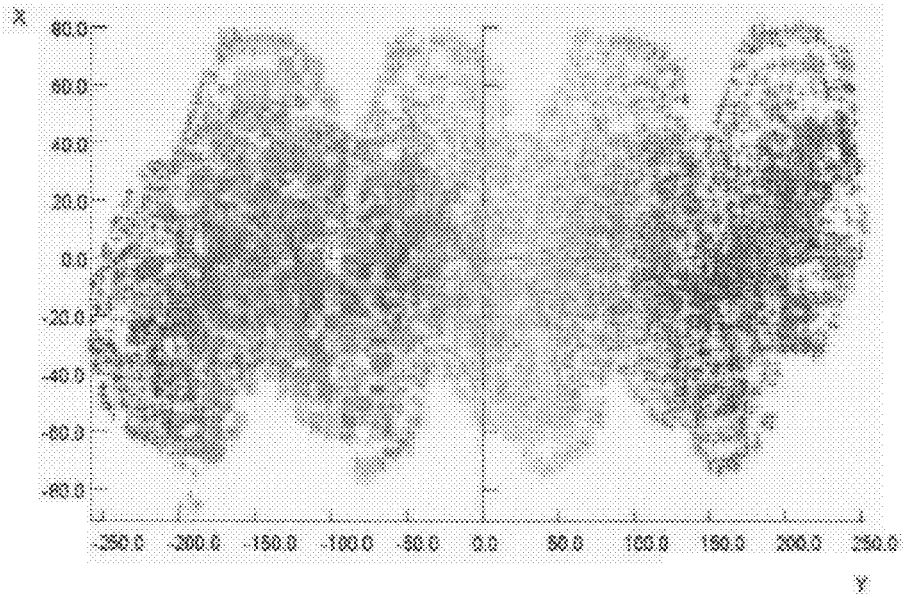
FIG. 3 (PRIOR ART)
FIG. 3 is a simulation result of electron beam emission in the FED of FIG. 2.

However, the FED with the gate focusing electrode 56 can suffer poor focusing due to changes in anode voltage and gate focusing voltage. FIG. 3 shows the result of simulation of electron beam emission in the FED of FIG. 2. Referring to FIG. 3, a beam profile becomes uneven as a gate focusing voltage varies, resulting in poor focusing. The poor focusing causes electrons to excite a phosphor layer other than the target phosphor layer, thereby degrading pixel uniformity.

Hereinafter, the present invention will be described in detail by explaining exemplary embodiments of the present invention with reference to the attached drawings. Like reference numerals in the drawings denote like elements.

Figure 4:
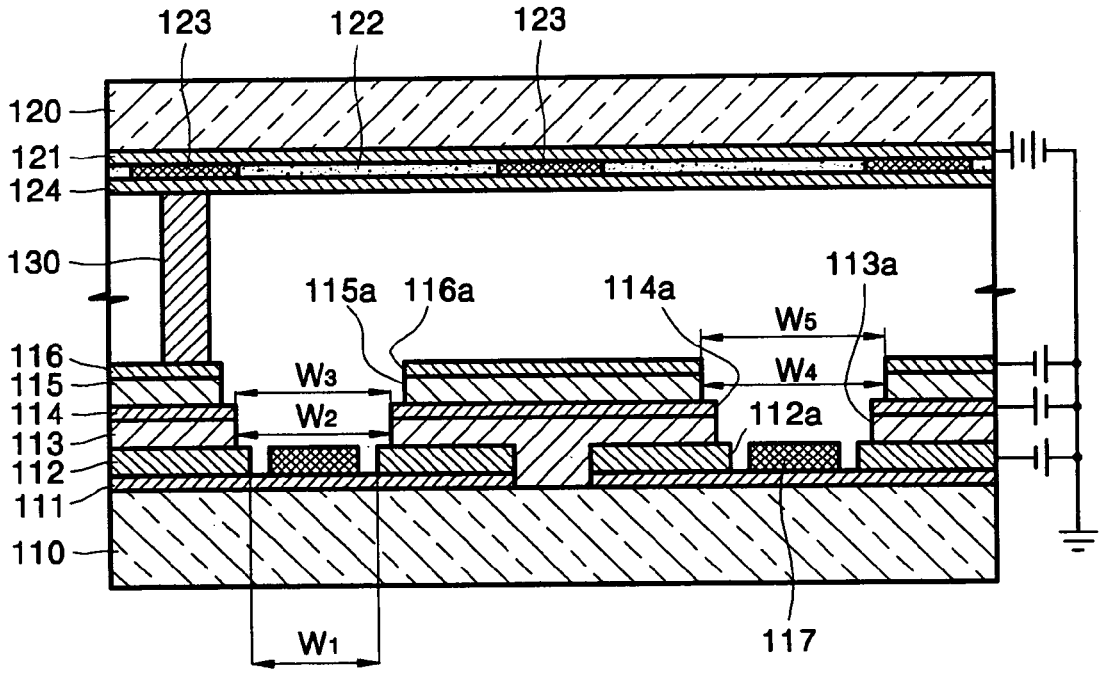
FIG. 4 is a partial cross-sectional view of a FED according to a first embodiment of the present invention.
Figure 5:
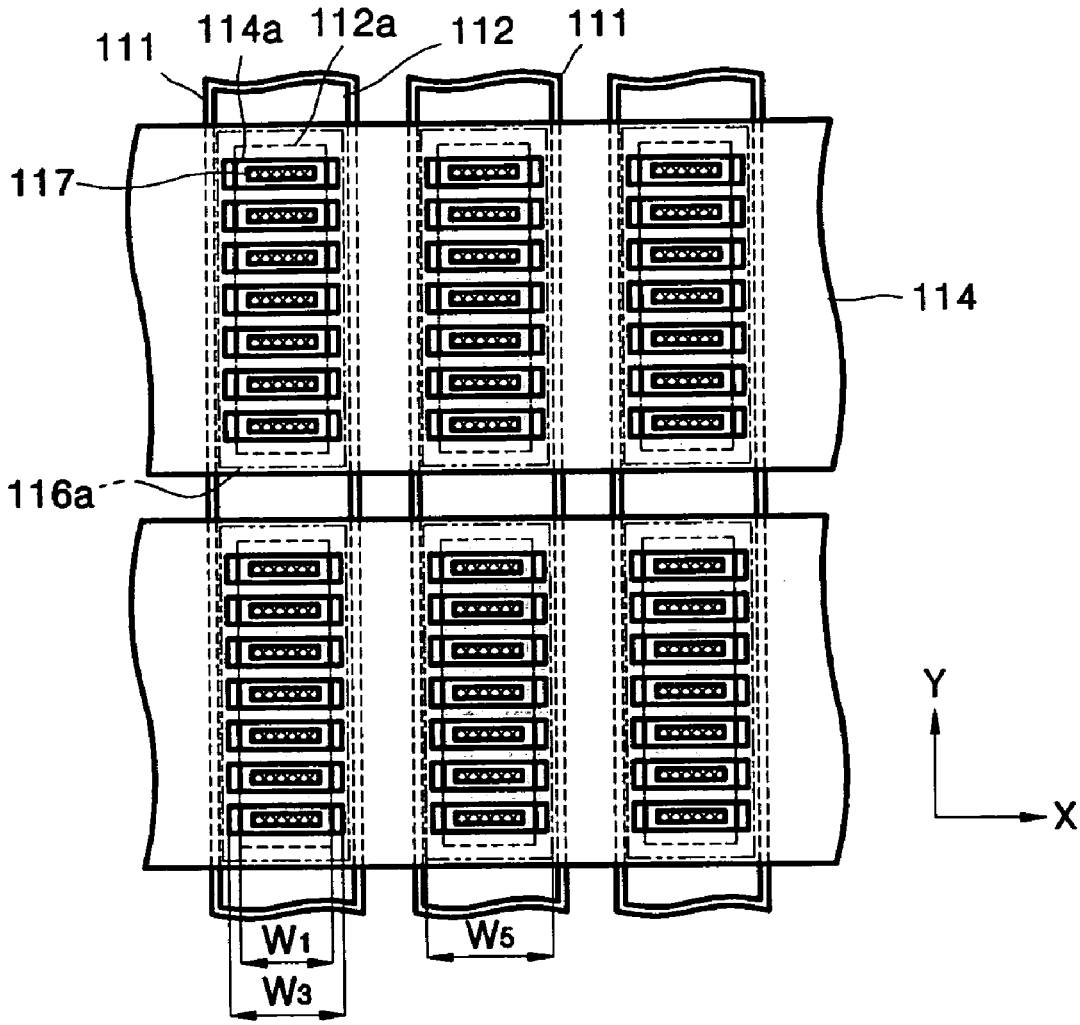
FIG. 5 is a partial top view of the arrangement of components on the rear substrate in the FED of FIG. 4.

FIG. 4 is a partial cross-sectional view of a FED according to a first embodiment of the present invention. FIG. 5 is a partial top view of an arrangement of components on the rear substrate of the FED of FIG. 4. For better visualization, only holes at gate focusing electrodes are shown In FIG. 5.

Referring to FIGS. 4 and 5, the FED includes a first substrate 110 and a second substrate 120 spaced apart from and disposed opposite each other. The first substrate 110 and the second substrate 120 are commonly respectively called a rear substrate and a front substrate. The rear and front substrates 110 and 120 are typically made of glass and are spaced apart by a spacer 130 disposed therebetween.

Components are arranged on the rear substrate 110 to induce field emission while components are arranged on the front substrate 120 to create an image using field-emitted electrons.

More specifically, cathode electrodes 111 are arranged on the rear substrate 110 in a striped pattern. The cathode electrodes 111 can be a conductive metal or a transparent conductive material, such as Indium Tin Oxide (ITO).

A cathode focusing electrode 112 is formed on and electrically connected to the cathode electrode 111. The cathode focusing electrode 112 has a first aperture 112*a* through which the cathode electrode 111 is exposed. A thickness of the cathode focusing electrode 112 can be 1 to 5 μm. The first aperture 112*a* is elongated in the direction of the cathode electrode 110, i.e., in the Y direction. The cathode focusing electrode 112 and the cathode electrode 111 can be integrated into a single unit.

A first insulating layer 113 is formed on the rear substrate 110 and the cathode focusing electrodes 112 to a thickness of about 3 to 15 μm. The first insulating layer 113 has a plurality of second apertures 113*a* connected to the first aperture 112*a*. That is, the plurality of second apertures 113*a* are formed in regions (each corresponding to one pixel) where the cathode electrode 111 is orthogonal to a gate electrode 114 (to be described later). Each of the plurality of second apertures 113*a* has a rectangular shape and is elongated in the X direction, that is, the direction perpendicular to the longitudinal direction (Y direction) of the cathode electrode 111. The width $W_2$ of the second aperture 113*a* is greater than or equal to the width $W_1$ of the first aperture 112*a*.

A plurality of gate electrodes 114 are arranged on the first insulating layer 113 at regular intervals in a predetermined pattern, e.g., in a striped pattern. Each of the plurality of gate electrodes 114 extends in the X direction. The gate electrode 114 can be a conductive metal, such as chrome (Cr), to a thickness of several thousand Angstroms (Å). The gate electrode 114 has a plurality of third apertures 114*a* connecting with the corresponding second apertures 113*a*. The third aperture 114*a* is transversely elongated perpendicular to the first aperture 112*a*. The plurality of second and third apertures 113*a* and 114 are formed for each pixel. The third aperture 114*a* with the same shape as the second aperture 113*a* has a width $W_3$ greater than or equal to the width $W_2$ of the second aperture 113*a*.

A second insulating layer 115 is formed on the first insulating layer 113 and the gate electrode 114 to a thickness of about 5 to 15 μm. The second insulating layer 115 has a fourth aperture 115*a* connected to the first aperture 112*a*. The width $W_4$ of the fourth aperture 115*a* is greater than the width $W_1$ of the first aperture 112*a*.

A plurality of gate focusing electrodes 116 are formed on the insulating layer 115 in a striped pattern along the Y direction. The gate focusing electrode 116 can be a conductive metal, such as Cr, to a thickness of several thousand Angstroms (Å). The gate focusing electrode 116 has a fifth aperture 116*a* connected to the fourth aperture 115*a*. The fifth aperture 116*a* is elongated in the Y direction and has a width $W_5$ equal to the width $W_4$ of the fourth aperture 115*a*.

An emitter 117 is disposed on the cathode electrode 111 within the first aperture 112*a*. The emitter 117 can be the same height as the cathode focusing electrode 112. The emitter 117 uses an electric field created by a voltage supplied among the cathode electrode 111, the cathode focusing electrode 112, and the gate electrode 114 to emit electrons. The emitter 117 can be a carbon-based material, such as graphite, diamond, Diamond like Carbon (DLC), $C_{60}$ (Fulleren), or Carbon NanoTubes (CNTs). In particular, CNTs allowing easy electron emission at low driving voltage are suitable for the emitter 117.

In the present embodiment, the emitter 117 is exposed through the first aperture 112*a* and elongated in the X direction. That is, a plurality of emitters 117 are arranged in the longitudinal direction of the first aperture 112*a*.

Referring to FIGS. 4 and 5, an anode electrode 121 is formed on one surface, i.e., the bottom surface of the front substrate 120, disposed opposite the rear substrate 110, and phosphor layers 122 consisting of Red (R), Green (G), and Blue (B) phosphors are formed on the surface of the anode electrode 121. The anode electrode 121 is a transparent conductive material, such as ITO, to permit the transmission of visible light emitted from the phosphor layers 122. The phosphor layer 122 is elongated along the longitudinal direction (Y direction) of the cathode electrode 111.

Black matrices 123 are formed between the phosphor layers 122 and improve contrast. A metal thin film 124 of aluminum (Al), for example, can be arranged on the phosphor layers 122 and the black matrices 123 to a thickness of several hundred Angstroms. This thickness is sufficiently small to permit easy passage of electrons emitted from the emitter 117 and accelerated. The metal thin film 124 serves to improve the brightness of the FED. That is, when R, G, and B phosphors in the phosphor layers 122 are excited by the electron beams emitted from the emitters 117 to emit visible light, the visible light is reflected by the metal thin film 124. Furthermore, back-scattered electrons striking the phosphor layers 122 bounce back from the metal thin film to the phosphor layers 122, thereby increasing the amount of visible light emitted from the FED and improving the brightness.

When the metal thin film 124 is formed on the front substrate 120, the anode electrode 121 can be omitted. This is because the conductive metal thin film 124 can act an anode electrode. The rear substrate 110 and the front substrate 120 constructed as above are spaced apart from each other such that emitter 117 faces the phosphor layer 122 and are attached to each other by a sealing material (not shown) between the substrates 110 and 120. As described earlier, the spacer 130 is disposed between the rear and front substrates 110 and 120 to maintain a distance therebetween.

The operation of the FED having the above-mentioned configuration is as follows. In the FED, when a predetermined voltage is supplied to the cathode electrode 111 or the cathode focusing electrode 112, the gate electrode 114, the gate focusing electrode 116, and the anode electrode 121, an electric field is created among the electrodes 111 or 112, 114, 116, and 121, causing electrons to be emitted from the emitter 117. A negative voltage of 0 to several tens of volts is supplied to the cathode electrode 111 and the cathode focusing electrode 112. A positive voltage of several to several tens of volts, a negative voltage of several ten volts, and a positive voltage of several hundred to several thousand volts are respectively supplied to the gate electrode 114, the gate focusing electrode 116, and the anode electrode 121. Electrons emitted from the emitter 117 are focused and accelerated toward and strike the phosphor layer 122. The R, G, and B phosphors in the phosphor layers 122 are excited to emit visible light. Electrons emitted from the emitter 117 are first focused by the cathode focusing electrode 112 and then by the gate focusing electrode 116, thereby improving the focusing efficiency of the electron beam.

The electron beam can also be more effectively focused by adjusting the width $W_1$ of the first aperture 112*a* and the height of the cathode focusing electrode 112, thereby allowing the peak current density to be precisely within the desired pixel of the phosphor layer 122.

As described above, the FED according to the first embodiment of the present invention improves focusing characteristics of electron beams emitted from the emitter 117, increases the current density, and allows the peak current density to be precisely located within the desired pixel, thereby improving color purity and brightness of an image and consequently providing high image quality.

Figure 6:
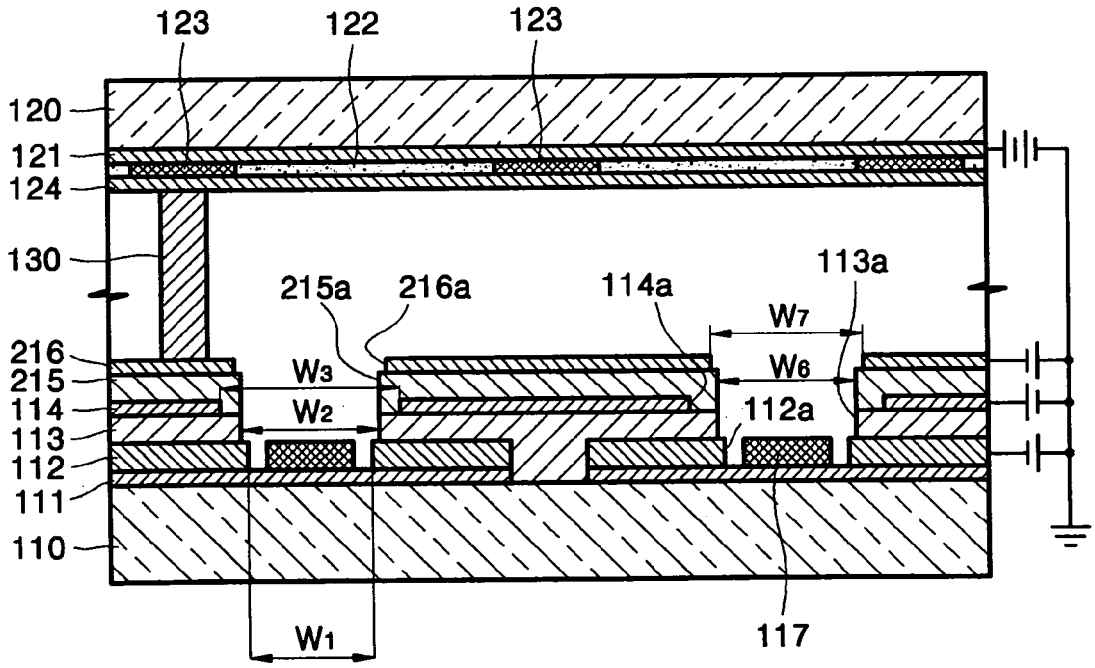
FIG. 6 is a partial cross-sectional view of a FED according to a second embodiment of the present invention.

FIG. 6 is a partial cross-sectional view of a FED according to a second embodiment of the present invention. A description of elements having the same reference numerals as their counterparts of FIG. 4 has been omitted.

Referring to FIG. 6, the FED includes a spacer 130 between a rear substrate 110 and a front substrate 120 disposed opposite and spaced apart from each other. Cathode electrodes 111 are arranged on the rear substrate 110 in a striped pattern. A cathode focusing electrode 112 is formed on the cathode electrode 111 and has a first aperture 112*a* through which the cathode electrode 111 is exposed.

A first insulating layer 113 is formed on the rear substrate 110 and the cathode focusing electrodes 112. The first insulating layer 113 has a plurality of second apertures 113*a* connected to the first aperture 112*a*. The width $W_2$ of the second aperture 113*a* is equal to or greater than the width $W_1$ of the first aperture 112*a*.

A plurality of gate electrodes 114 are arranged on the first insulating layer 113 at regular intervals in a predetermined pattern, e.g., in a striped pattern. The gate electrode 114 has a third aperture 114*a* connected to the second aperture 113*a*. The third aperture 114*a* has a width $W_3$ equal to or greater than the width $W_2$ of the second aperture 113*a*.

A second insulating layer 215 is formed on the first insulating layer 113 and covers the gate electrode 114. The second insulating layer 215 has a fourth aperture 215*a* connected to the first aperture 112*a*. The width $W_6$ of the fourth aperture 215*a* is greater than the width $W_1$ of the first aperture 112*a*.

A plurality of gate focusing electrodes 216 are formed on the insulating layer 215 in a striped pattern along the Y direction. The gate focusing electrode 216 has a fifth aperture 216*a* connected to the fourth aperture 215*a*. The fifth aperture 216*a* is elongated in the Y direction and has a width $W_7$ that is less than the width $W_3$ of the third aperture and greater than the width $W_1$ of the first aperture 112*a*.

An emitter 117 is disposed on the cathode electrode 111 within the first aperture 112*a*. The emitter 117 can be the same height as the cathode focusing electrode 112. The emitter 117 uses an electric field created by a voltage supplied among the cathode electrode 111, the cathode focusing electrode 112, and the gat electrode 114 to emit electrons.

An anode electrode 121 is formed on one surface, i.e., the bottom surface of the front substrate 120, disposed opposite the rear substrate 110, and phosphor layers 122 consisting of R, G, and B phosphors are formed on the surface of the anode electrode 121. Black matrices 123 are formed between the phosphor layers 122 to improve contrast. A metal thin film 124 is formed on the phosphor layers 122 and the black matrices 123.

The simulation result for electron beam emission in a FED according to the present invention is as follows. Design values of elements in the FED are set for the simulation. For example, when a FED screen has an aspect radio of 16:9, diagonal length of 38 inches, and a horizontal resolution of 1280 lines to achieve high definition image quality, a RGB trio-pitch can be set to less than about 0.70 mm.

In this case, the height of a cathode focusing electrode can be set to 1 to 3 μm, and the widths $W_1$, $W_3$, and $W_5$ of the first, third, and fifth apertures can be respectively set to 30 to 50 μm, 50 to 70 μm, and 50 to 80 μm. It will be readily apparent to those of ordinary skill in the art that the dimensions of the components can vary depending on the size, aspect ratio, and resolution of the screen of the FED.

Figure 7:
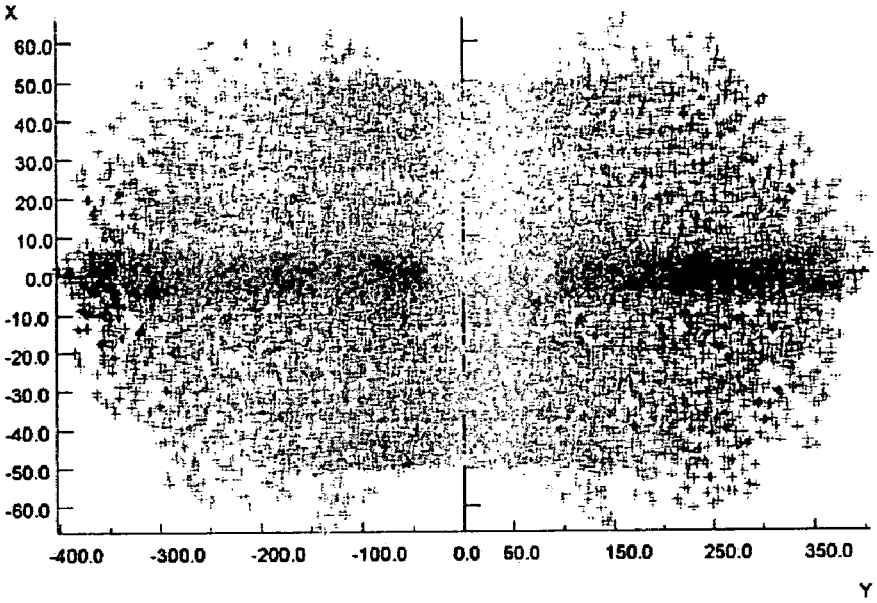
FIGS. 7 and 8 are simulation results of electron beam emission in the FED of FIG. 4.
Figure 8:
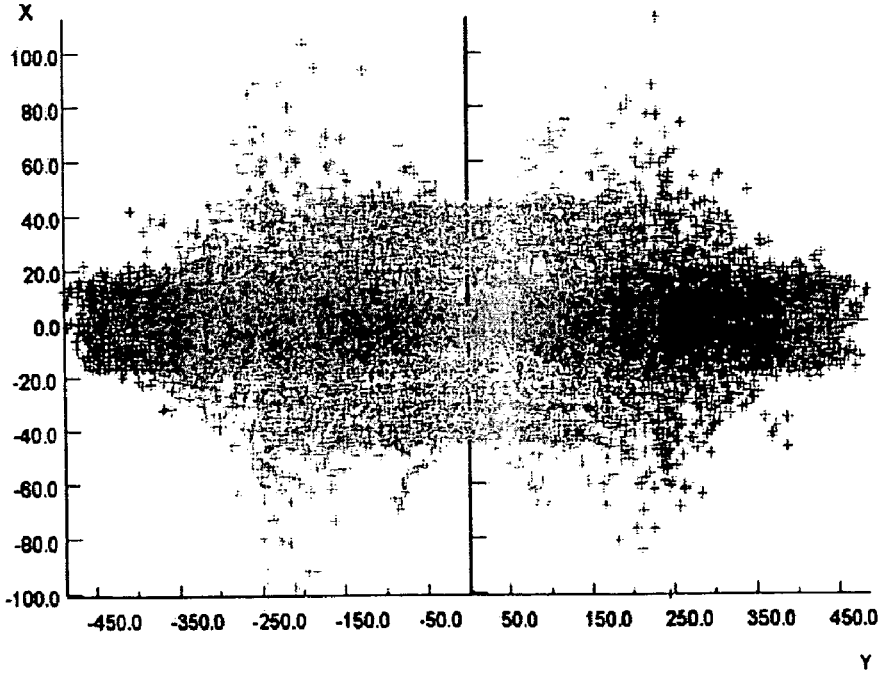

FIGS. 7 and 8 are simulation results of electron beam emission in the FED of FIG. 4. FIGS. 7 and 8 respectively show distributions of electron beams over the front substrate 120 at anode driving voltages of 3,000 V and 1,500 V.

The simulation result demonstrates that the FED according to the present invention including gate focusing electrodes at either side of an emitter, allows effective focusing of electron beams emitted from the emitter.

As described above, a FED according to the present invention includes a horizontally elongated emitter within a gate hole and a cathode focusing electrode formed at either side of the emitter, thereby improving the focusing characteristics of electron beams emitted from the emitter, in particular, horizontal focusing capability that is the most important factor affecting color coordinates. Thus, the FED of the present invention provides high color purity and high image quality.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Field Emission Display (FED), comprising:

a first substrate;

a cathode electrode arranged on the first substrate in a first direction;

a cathode focusing electrode arranged on the cathode electrode and having a rectangular first aperture elongated in the first direction;

an insulating layer arranged on the first substrate to cover the cathode focusing electrode and having a plurality of second apertures arranged in regions where the insulating layer overlaps the cathode electrode in a second direction perpendicular to the first direction and connected to the first aperture;

a gate electrode arranged on the insulating layer to extend in the second direction and having a plurality of third apertures connected to the corresponding second apertures;

an emitter arranged on the cathode electrode within the first aperture; and a second substrate arranged opposite to and spaced apart from the first substrate and having an anode electrode and a phosphor layer thereon;

wherein the third aperture is elongated in the second direction so as to be longer in the second direction than in the first direction; and wherein the first aperture corresponds to each pixel, and wherein the plurality of second and third apertures are arranged for each pixel.

2. The FED of claim 1, wherein the width of the third aperture in the second direction is greater than the width of the first aperture in the second direction.

3. The FED of claim 1, wherein the cathode electrode is electrically connected to the cathode focusing electrode.

4. The FED of claim 1, wherein the emitter comprises a carbon-based material.

5. The FED of claim 4, wherein the emitter comprises Carbon NanoTubes (CNTs).

6. A Field Emission Display (FED), comprising:

a first substrate;

a cathode electrode arranged on the first substrate in a first direction;

a cathode focusing electrode arranged on the cathode electrode and having a rectangular first aperture elongated in the first direction;

a first insulating layer arranged on the first substrate to cover the cathode focusing electrode and having a plurality of second apertures arranged in regions where the insulating layer overlaps the cathode electrode in a second direction perpendicular to the first direction and connected to the first aperture;

a gate electrode arranged on the first insulating layer to extend in the second direction and having a plurality of third apertures connected to the corresponding second apertures;

a second insulating layer arranged on the first insulating layer and having a fourth aperture elongated in the first direction and connected to the third apertures;

a gate focusing electrode arranged on the second insulating layer and having a fifth aperture connected to the fourth aperture;

an emitter arranged on the cathode electrode within the first aperture; and a second substrate arranged opposite to and spaced apart from the first substrate and having an anode electrode and a phosphor layer thereon;

wherein the third aperture is transversely elongated in the second direction so as to be longer in the second direction than in the first direction; and wherein the first aperture corresponds to each pixel, and wherein the plurality of second and third apertures are arranged for each pixel.

7. The FED of claim 6, wherein the width of the third aperture in the second direction is greater than the width of the first aperture in the second direction.

8. The FED of claim 6, wherein the width of the fifth aperture in the second direction is greater than the width of the third aperture in the second direction.

9. The FED of claim 6, wherein the width of the fifth aperture is greater than the width of the first aperture and less than the width of the third aperture.

10. The FED of claim 6, wherein the cathode electrode is electrically connected to the cathode focusing electrode.

11. The FED of claim 6, wherein the emitter comprises a carbon-based material.

12. The FED of claim 11, wherein the emitter comprises Carbon NanoTubes (CNTs).

* * * * *